US005513979A

United States Patent [19]

Pallek et al.

[11] Patent Number: 5,513,979

[45] Date of Patent: May 7, 1996

[54] CONTROL OR REGULATING SYSTEM FOR AUTOMATIC GAS FURNACES OF HEATING PLANTS

[75] Inventors: Anton Pallek, Baden-Baden; Michael Oberst, Karlsruhe, both of Germany

[73] Assignee: Landis & Gyr Business Support A.G., Zug, Switzerland

[21] Appl. No.: 201,544

[22] Filed: Feb. 25, 1994

[30] Foreign Application Priority Data

Mar. 5, 1993 [CH] Switzerland ..... 661/93

[51] Int. Cl.[6] ..... F23N 5/00

[52] U.S. Cl. ..... 431/90; 431/12; 431/18; 431/89; 126/116 A

[58] Field of Search ..... 431/18, 12, 89, 431/90; 126/116 A

[56] References Cited

U.S. PATENT DOCUMENTS 4,348,169 9/1982 Swithenbank et al. .

FOREIGN PATENT DOCUMENTS

| | | |
|---|---|---|
| 2920343 | 11/1979 | Germany . |
| 4007699 | 12/1991 | Germany . |
| 2061415 | 3/1970 | Japan . |
| 59-212621 | 12/1984 | Japan . |
| 3291411 | 12/1991 | Japan . |
| 4113117 | 4/1992 | Japan . |
| 2187309 | 2/1986 | United Kingdom . |

*Primary Examiner*—Larry Jones
*Attorney, Agent, or Firm*—Meltzer, Lippe, Goldstein et al.

[57] ABSTRACT

A control or regulating system for an automatic heat furnace is disclosed. This control system simplifies the construction of automatic gas furnaces for heating plants. The control system operates the furnaces with a high degree of efficiency and low pollutant emission, even at partial capacity. The adjusting element or mechanism for air is a blower with adjustable rotational speed which is driven by a motor. The motor is controllable by, preferably, digital pulse-width modulated control signals of a control aggregate acted upon by a regulator. A gas valve regulates the pressure of the gas supplied to the burner as a function of the air pressure in the line leading from the blower to the burner.

25 Claims, 2 Drawing Sheets

CONTROL OR REGULATING SYSTEM FOR AUTOMATIC GAS FURNACES OF HEATING PLANTS

FIELD OF THE INVENTION

The instant invention relates to a control or regulating system for heating plants having automatic gas furnaces. Generally, such heating plants use gas as a combustible fluid. The gas is at a pressure which is adjustable. Air can be fed through a connecting line or pipe by a blower to the burner of a boiler. The air pressure in the connecting line or pipe between the blower and the boiler is also adjustable. A pressure regulator regulates the quantity of air in the connecting line or pipe.

BACKGROUND OF THE INVENTION

Control systems for furnaces are known. The heating capacity of these systems depends on the quantity of combustible fluid fed to the burner and on the ratio between this quantity and the combustion air fed to the burner. To obtain an optimal heating effect, an adjustment of the ratio between the fluid and the air is recommended. In known control systems, the air is conveyed to the burner through a connecting line or pipe by a blower having a constant rotational speed. A butterfly valve controlled by the regulator is used in the connecting line to control the air pressure. Control of the pressure adjuster for the combustible fluids fed to the burner is effected as a function of the air pressure.

SUMMARY OF THE INVENTION

It is an object of the instant invention to simplify such a control or regulating system, especially from the standpoint of design. Another object of the present invention is to obtain desired energy savings. Yet another object of the present invention is to enable burners to achieve a high level of efficiency and operation with a minimum of pollutants, even with burners of relatively low capacity, such as approximately 30 Kw.

The present invention accomplishes these objectives by providing a control system for automatic gas furnaces of heating plants. The control system comprises a burner located in a heating boiler to which a combustible fluid is fed, a first adjusting means for adjusting pressure of the combustible fluid, and a second adjusting means connected to the burner by a connecting line for adjusting pressure of air conveyed in the connecting line. The second adjusting means being provided with a regulator for regulating the quantity of air conveyed in the connecting line, a blower having adjustable rotational speed for conveying the air through the connecting line to the burner of the heating boiler, a motor for driving the blower, and a control aggregate for controlling the motor via control signals acting on the regulator.

In the present invention, the utilization of a butterfly valve to control the air pressure is foregone. Instead, the air pressure is varied by controlling the rotational speed of the blower. In this manner, not only is the expense of an additional butterfly valve with its appertaining mechanically moving parts and its susceptibility to failure avoided, but drive energy can also be saved since the blower can be operated at a rotational speed adapted to the required air pressure. This operation of the blower is in contrast to the prior art where the blower must always operate at the highest rotational speed no matter what the magnitude of the required air pressure in the connecting line may be. To drive the continuously modulated blower, a d.c. motor is used which is preferably controlled by pulse-width modulation. Pulse width modulation involves acting upon the digital control signals of a control system by a regulator.

It is known from DE-OS 29 20 343 that drive mechanisms in the form of motors can be used in the burners as valves in the fuel and air supply lines. These mechanisms can be controlled as a function of measurable variables. However, these drive mechanisms are servomotors or actuators which regulate the positions or settings of the valves.

While the ratio between the fluid pressure and the air pressure can be produced in known control systems by adjusting or following up the fluid pressure as a function of air pressure in order to convey the desired fluid-air proportion to the burner, the air pressure of the present invention is controlled as a function of heat requirement or according to heat-level determining parameters. The air pressure control is accomplished by the rotational speed control of the d.c. motor and, therefore, by the blower.

Such control and regulating systems can be used, for instance, for small gas heaters, wall or standing models, having gas blower burners. By means of these systems the heating water of a heating plant, as well as hot utility water in single-family homes or upstairs apartments, can be regulated particularly within a capacity range up to 30 Kw. As stated earlier, it is recommended here to use the air pressure as the guiding parameter for the gas pressure regulator of the compact gas regulating line. A modulation range of at least approximately 1:3, e.g., 10–30 Kw, but preferably over 1:5, makes it possible to achieve optimal effect and operation with a minimum of pollutants, even in low-capacity ranges.

It is, therefore, recommended to measure, preferably by means of Hall sensors, the rotational speed of the blower or of the d.c. motor, and to compare measured speed with suitable desired rotational speed values, as in the present invention. Output signals, which are functions of the magnitudes of the difference between the measured rotational speed and the desired rotational speed, are produced. These signals are then used to control the pulse-width modulated signals for the d.c. motor and the blower. The desired values of rotational speed are used particularly for plausibility tests in automatic furnaces. In such tests, a given desired rotational speed value would have to be exceeded during the pre-rinse period.

If gas is used as the combustible fluid, a control valve is used as the adjusting element for the fluid.

The motor used as the drive for the blower is preferably a d.c. motor with a power voltage of approx. 35–40 V. Such a motor takes up little space and is relatively inexpensive.

The air pressure in the connecting lines between the blower and the burner can also be used for other control tasks. Thus, it is possible to carry out a shut-down when the air pressure drops below a limit value. The actual rotational speed values of the blower or of its d.c. motor represent a measurement for the air pressure in the connecting line. The actual rotational speed values are preferably read by Hall sensors. However, if the ventilator slips from the blower shaft or if the adjustment of ventilator blades is changed, a decrease in the air pressure can be produced even if the rotational speed of the blower remains constant. If, however, the air pressure is read in the connecting line and found to have dropped below a limit value, malfunction is signalled. However, during the "run-up phase", i.e., during pre-rinse, it is necessary for a given air pressure to be present before the automatic furnace initiates any further phases. This is to ensure that the air pressure is constantly read at that location.

However, in "burner operation", i.e., after the "run-up phase", it is sufficient for the air pressure to be read only occasionally. This is particularly true when the actual rotational speed value is greater than a given desired value. If insufficient air pressure is present during the burner operation, the automatic furnace initiates a repetition of the process.

An ignition signal can also be produced for the ignition aggregate or system of the burner as a function of a rotational speed limit or threshold value. The ignition signal starts up the burner operation by means of an automatic furnace. At the same time, the control system then functions as part of an automatic furnace.

Control can also be effected so that a time switch ensures high blower speed and high air pressure, and, at the same time, prevents the feeding of combustible fluid to the burner. High blower speed and air pressure occurs with a high rate of air through the burner and the heating or combustion chamber during a predetermined pre-rinse period.

Correspondingly, a signal can also be produced when the supply of combustible fluid is shut off. This signal causes the control aggregate to continue transmitting a control signal to the d.c. motor of the blower for a certain time, while the fuel supply is shut off. This continuation of the control signal allows rinsing of the burner, heating chamber, and flue with air and frees them from combustion gases.

The effect of this pre-rinse or post-rinse is optimized when the control signals bring the rotational speed of the d.c. motor to full capacity, since the greatest quantity of air per time unit is then put through.

During the ignition period, the blower can be brought back to an adjustable value, e.g. between 50 and 70% of its maximum rotational speed, in order to achieve optimal ignition with simultaneous utilization as an automatic furnace. The maximum rotational value is its full capacity.

BRIEF DESCRIPTION OF THE DRAWINGS

Examples of embodiments of the invention are explained below with reference to the drawings.

DETAILED DESCRIPTION OF THE INVENTION

Figure 1:
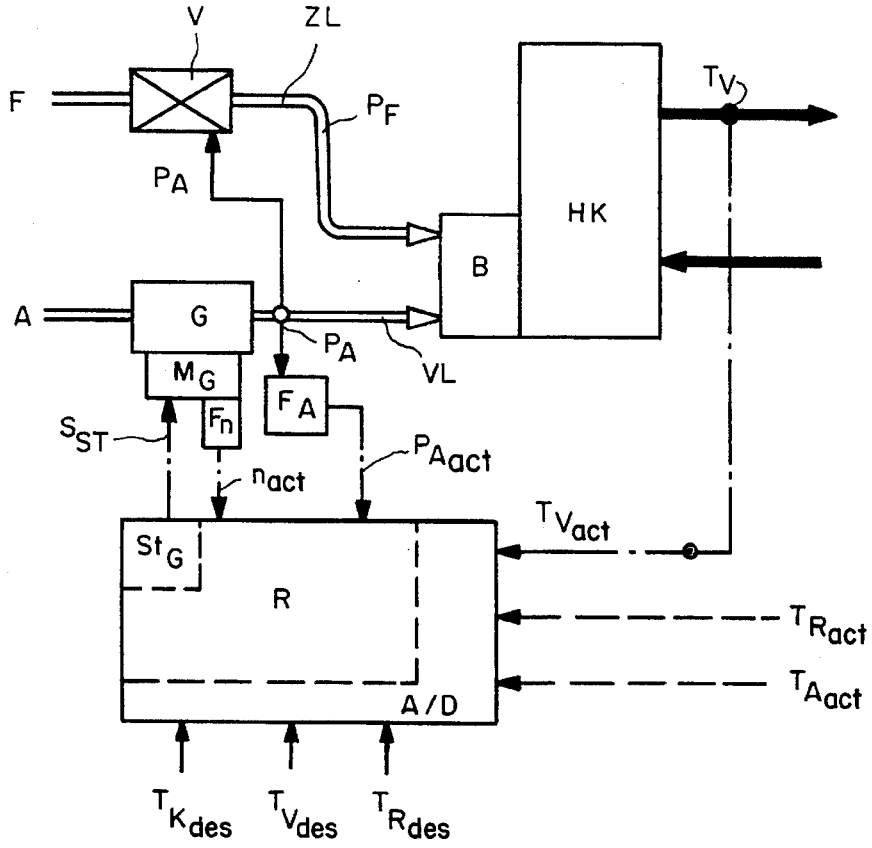
FIG. 1 shows a schematic diagram of a control system according to the invention.

According to FIG. 1, gas flows in the form of a combustible fluid F via a supply line ZL to the burner B of a heating boiler HK. The gas pressure $P_F$ of the fluid F is regulated by a pneumatically equal or balanced pressure regulating valve V. The regulation is a function of the air pressure $P_A$ transmitted from the output of the blower G to the regulating valve V. The temperature regulator R adjusts the rotational speed $n_{act}$ of the motor $M_G$, and, thereby, also the air pressure $P_A$ in the connecting line VL. The balanced pressure valve V readjusts the gas pressure $P_F$ as a function of the actual value of the air pressure $P_A$, so that the optimal quantity of gas is always readjusted as a function of the air quantity of the moment. The d.c. motor $M_G$, having a capacity of up to 22 VA, can be set for rotational speeds between approximately 200 and 6000 Rpm. The air A is fed via connecting line VL to the burner B. The air pressure $P_A$ in the connecting line VL is detected by the air pressure sensor $F_A$ according to a special embodiment of the invention. The blower G is driven by a 39 V d.c. motor $M_G$. The rotational speed of the motor can be detected in the form of an actual rotational speed value $n_{act}$ by means of a rotational speed sensor $F_n$. The speed sensor $F_n$ is, preferably, a Hall sensor.

The temperature is regulated via regulator R as a function of the actual temperature values, e.g., the room temperature $T_R$, the boiler temperature $T_K$, the external temperature $T_A$, and/or the flow temperature $T_V$. The actual temperature values are transmitted to the regulator via an analog/digital (A/D) converter and are related to the present desired temperature values, e.g., $T_{Bdes}$ or $T_{Fdes}$. In this example, the regulator R produces an output signal which corresponds to the desired rotational speed value n. The output signal is compared in the comparator with the actual rotational speed value $n_{act}$. The control aggregate $ST_G$ can be influenced by the type, positive or negative, and/or magnitude of the difference between the desired and actual rotational speed values. The control aggregate $St_G$ can in turn produce corresponding control signals $S_{ST}$ for the control or regulation of the rotational speed of the d.c. motor $M_G$.

Figure 2:
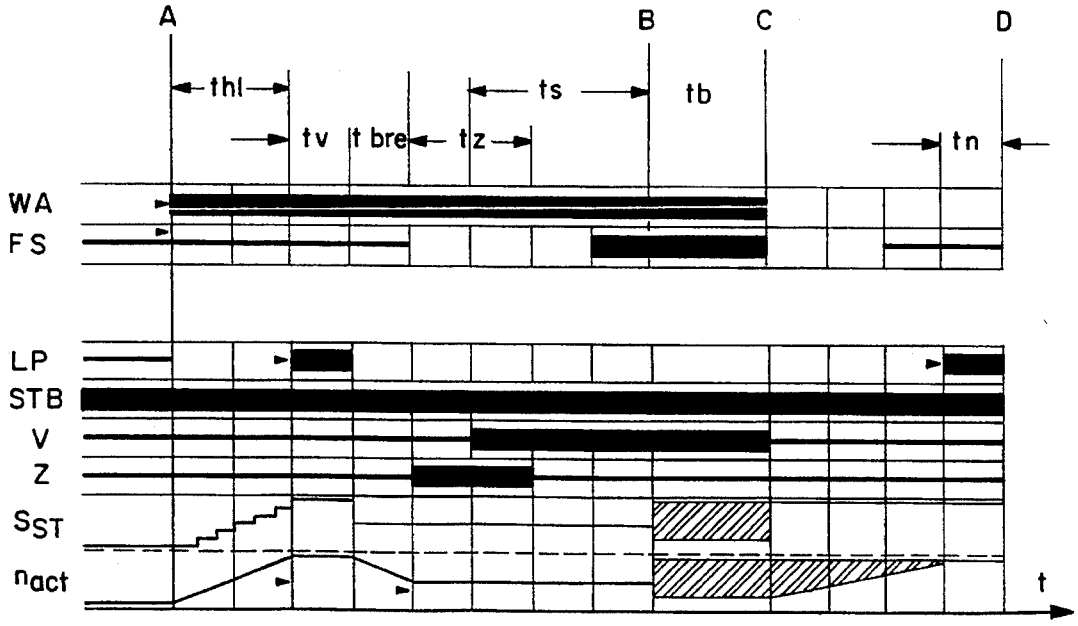
FIG. 2 shows a time-related flow chart of functions of aggregates of the control system in the invention.

In the flow chart of FIG. 2, the thick lines in rows WA to Z the thick lines indicate the required signals and the thin lines indicate the inadmissible signals. The abbreviations are defined as followed:

WA: Heat requirement or heat demanded by the regulator

FS: Flame signal

LP: Air pressure message from the external air pressure sensor $F_A$

STB: Safe-temperature limiter

V: Gas valve in the supply line ZL

Z: Ignition signal going to the igniting aggregate $S_{ST}$: Control signal to the d.c. motor of the blower $n_{act}$: Actual rotational speed value derived from the Hall rotational speed sensor $F_n$ thl: Time required for running up the blower tv: Pre-rinse time period tbre: Braking time period for the blower tz: Ignition time period ts: Safety time period tb: Operating time period of burner regulator tn: Post-rinse time period t: Time A: Starting command (Regulator switched on)

B: Start of burner operation

C: Start of shut-down

D: End of shut-down and transition into home-run time period

At the point in time A, the regulator element of the control system transmits a starting command A to the automatic furnace. The transmittal may be done when the temperature T, in the utility water circuit or in the heating circuit, has dropped below a minimum value. During the run-up time period thl, pulse-width modulated control signals $S_{ST}$ are preferably transmitted to the d.c motor $M_G$ of the blower G, so that the rotational speed value $n_{act}$ of the blower increases to a maximum value. The transmittal occurs as soon as a desired value has been reached and the external air pressure signaller LP closes its contact. The desired value can be the desired rotational speed which is adjustable. Then the pre-rinse time period tv begins. At this point in time, air pressure $P_A$ is attained in the connecting line VL. In order to keep the pre-rinse time period short, it is recommended to allow the blower G to run at full capacity during the pre-rinse time period tv. The automatic furnace can continue its functions with the acknowledgment of the actual rotational speed value $n_{act}$ and the actual air pressure value when the required minimum values have been reached. If the rotational speed and/or the air pressure have not reached the predetermined limit value before the beginning of the pre-rinse time period tv, a failure shut-down occurs.

Figure 3:
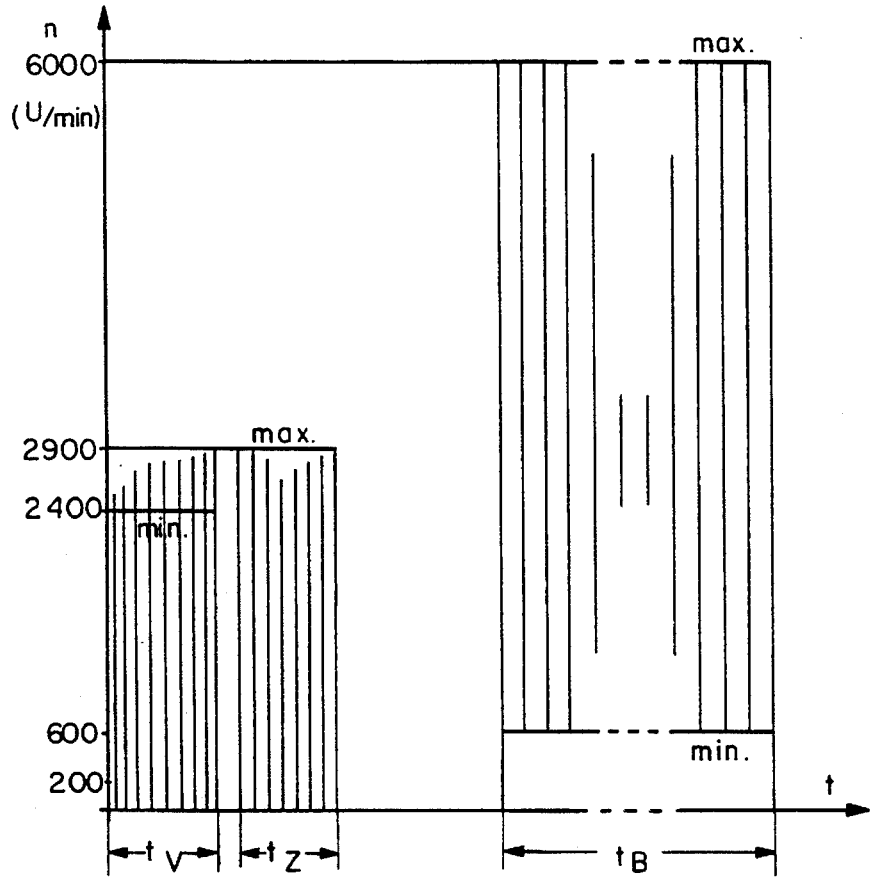
FIG. 3 shows rotational speed ranges during different time periods of the control system when starting the burner operation (as automatic furnace) and during heating operation (as temperature regulation)

According to FIG. 3, the actual rotational speed value $n_{act}$ of the blower G must exceed a minimum value of approximately 2400 RPM during the pre-rinse time period tv.

During the braking time period tbre, the rotational speed of the blower G is decreased corresponding to lower or decreased control signals $S_{ST}$.

An ignition signal Z is thereupon transmitted during the ignition time period tz to an ignition aggregate of the burner B, while the blower G continues to run at the same rotational speed, e.g. 40% of the maximum rotational speed. The ignition aggregate can be ignition electrodes. However, the rotational speed is not allowed to exceed the maximum value which is 2900 RPM for this example, according to FIG. 3. In the course of the ignition time period tz the valve in supply line ZL opens. That is, the pneumatic pressure regulator or valve V of the combustible fluid F opens. Valve V serves as an adjusting aggregate so that the safety time period ts begins. During the safety time period ts, a flame sensor must detect a flame signal, otherwise a failure shut-down will occur. This safety time period ts may last up to 10 seconds, for example, while the pre-rinse period tv may last up to 50 seconds, for example. The same order of magnitude also applies to the maximum braking time period tbre.

If the flame signal is present at the end of the safety time period ts, the transition into the operational position takes place and the burner operating time period tb begins. During the operating time period, tb, the rotational speed $n_{act}$ is adjustable within a rotational speed range. The rotational speed range is calculated as a function of the control signals $S_{ST}$. The control signals $S_{ST}$ in turn, are adjustable as a function of the output signals from the regulator R. According to FIG. 3, the rotational speed range is between, approximately, 600 and 6000 RPM, as the maximum value indication and plausibility limit. The highest rotational speed typically reaches 4000 RPM. During the burner operating time period tb, it is not necessary to monitor the air pressure since the rotational-speed sensor $F_n$ provides sufficient safety with its output signals.

If the flow temperature $T_V$ is higher than the shut-off threshold, the regulator R stops burner operation at the point in time C by stopping the arrival of combustible fluid F at the burner B. This stoppage of fluid is accomplished by means of the adjusting element V. The blower G may, however, remain in operation in order to blow out combustion residues. During this shut-down time period, the blower speed $n_{act}$ is run up to full capacity, whereupon return motion follows as a regular transition to the standby phase. The full capacity may be programmable.

Figure 4:
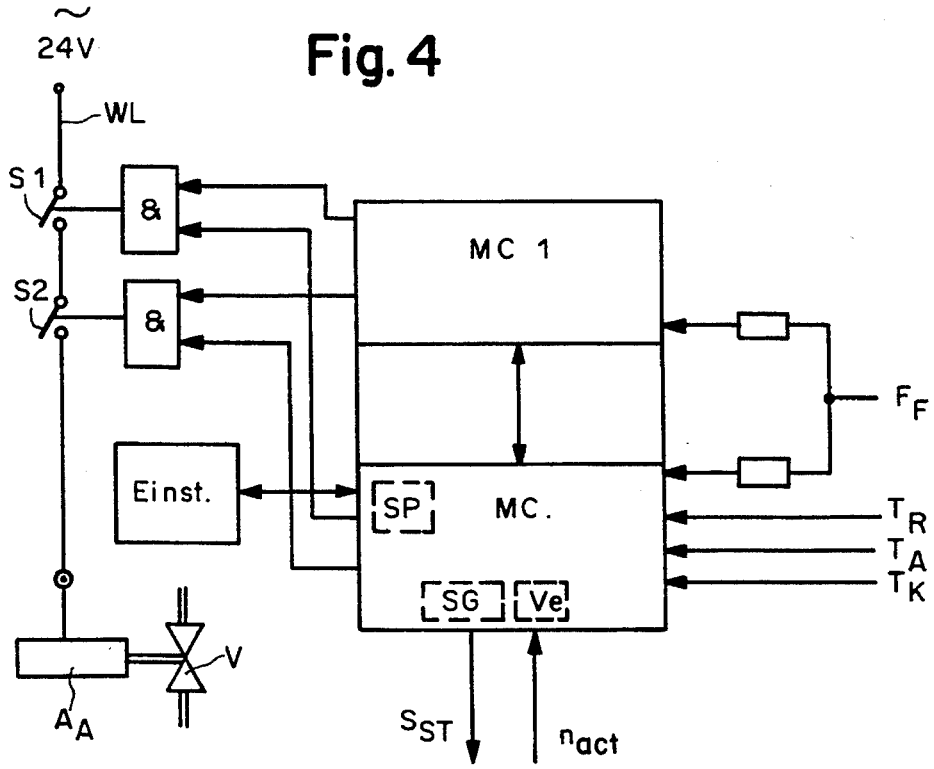
FIG. 4 shows a schematic diagram of an electronic control system by means of which the two tasks, that of an automatic furnace as well as that of a temperature regulator, are accomplished in an integrated construction according to a special embodiment of the invention.

A special embodiment of the invention is illustrated in FIG. 4. The system is equipped with a microcomputer MC. The microcomputer MC assumes the tasks of a temperature regulator, as well as those of an automatic furnace. The microcomputer MC may also be connected for data exchange to an additional microcomputer MC1. This additional microcomputer MC1 assumes a monitoring function in order to ensure the safety of the automatic furnace. The flame sensor $F_F$ transmits output signals to the microcomputer MC, as well as to the additional microcomputer MC 1 used for monitoring purposes. Both microcomputers, MC and MC1, can close or open two switching elements, along with the control clamps of the gas valve, independently of each other. The two computers also monitor each other for correct operation.

An adjusting device Einst makes it possible to program the microcomputer MC by entering data into the memory SP. The microcomputer MC causes the initialization of control signals $S_{ST}$ in the signal generator SG. The comparator Ve compares the actual rotational speed value $n_{act}$ with the programmed desired rotational speed values $n_{des}$. The comparison is done to take appropriate measures or to cause malfunction shut-downs in case of deviations from the rotational speeds, as shown in FIG. 3. Deviations occur if the rotational speeds are exceeded or not attained. The two microcomputers MC, MC1 act upon two switches S1, S2 which are connected in series to the 24-V a.c. by line WL. The line WL supplies the drive aggregate AA of the fuel gas valve V with a.c. current.

One advantage of the integration of the electronic control system, is that it is not necessary to use separate control systems, wherein each separate control system has appertaining components for the automatic furnace on the one hand and for the temperature regulator on the other hand. For example, the integration of control systems may, preferably, be installed on only two printed circuits with inserted components. Thus, one single signal generator SG is sufficient to generate and transmit the preferably pulse-width modulated control signals $S_{ST}$ which carry out their function for the control of the start-up program, as well as for temperature regulation during burner operation. The actual rotational speed values $n_{act}$ sensed by the Hall rotational-speed sensor $F_n$ can be evaluated for control and operation not only during the start-up program but also during the controlled burner operation. The start-up program is a function of the automatic furnace and temperature regulator during burner operation is a function of the regulator.

The air pressure monitor or sensor $F_A$ determines that sufficient air pressure has always been built up for pre-rinse of the combustion chamber and the flue, when the automatic furnace is operated, i.e., in the "start phase". During the operation of the temperature regulator R, that is to say in the modulating operation, the rotational speed n of the blower G may drop to such an extent. When the heat demand WA is low, the air pressure sensor $F_A$ is not triggered at all.

In such a case it is recommended to use an additional air pressure sensor which is triggered by low air pressure corresponding to low blower speed. One of the air pressure sensors can then be used, depending on the rotational speed range. In order to save the expense of such a second air pressure sensor, it is advantageous to scan the switching state of the air pressure sensor $F_A$ with every high heat demand calling for a rotational speed of the blower G that is so high that the air pressure sensor $F_A$ must react. If the air pressure sensor $F_A$ fails to react, a shut-down occurs followed by repetition of the starting procedure.

The air pressure sensor $F_A$ is also triggered in safety tests, whereby a brief shut-down and resumption of operation is provoked by the automatic furnace at least once every 24 hours.

We claim:

1. A control system for automatic gas furnaces of heating plants comprising, a burner located in a heating boiler to which a combustible fluid is fed, a first adjusting means for adjusting pressure of said combustible fluid, and a second adjusting means connected to said burner by a connecting line for adjusting pressure of air conveyed in said connecting line, and having a regulator for regulating a quantity of air conveyed in the connecting line, said second adjusting means further comprising, a blower having adjustable rotational sped for conveying said air through said connecting line to said burner of said heating boiler, a d.c. motor for driving said blower, a control aggregate for controlling said motor via digital pulse-width modulated control signals acting on said regulator, a comparator for comparing actual rotational speed values of said blower with a desired rotational speed value supplied by said regulator as an output signal, and wherein said control system is controllable as a function of output signals from said comparator, thereby regulating the rotational speed of said blower.

2. The control system of claim 1, wherein said combustible fluid is gas.

3. The control system of claim 1, wherein said regulator is a proportional or equalizing regulator.

4. The control system of claim 1, wherein said regulator regulates the conveyed air by an adjusting parameter which is a function of said air pressure.

5. The control system of the claim 1, further comprising, an air pressure sensor for sensing the air pressure in said connecting line between said blower and said burner when the actual rotational speed value is greater than said desired rotational speed value, and wherein said automatic furnace switches off and switches back on when said air pressure is insufficient.

6. The control system of claim 5, further comprising hall sensors to produce digital hall signals as said actual rotational speed values.

7. The control system of claim 5, wherein said second adjusting means for air pressure further comprising a purely pneumatic balanced-pressure regulating valve having two stop valves connected in series and wherein said stop valves are controllable by the air pressure in said connecting line.

8. The control system of claim 5, wherein said burner is operated within a modulation range of at least 1:3 by use of said motor.

9. The control system of claim 5, wherein said burner is operated within a modulation range of approximate 1:10 by use of said d.c. motor for the blower.

10. The control system of claim 5, further comprising a temperature regulator which changes said conveyed quantity of air by an adjusting parameter which is a function of heat demand.

11. The control system of claim 10, wherein said adjusting parameter is one of external temperature, room temperature of room to be heated, boiler temperature, the flow temperature or any combination thereof.

12. The control system of claim 1, further comprising hall sensors to produce digital hall signals as said actual rotational speed values.

13. The control system of claim 1, wherein said second adjusting means for air pressure further comprises a purely pneumatic balanced-pressure regulating valve having two stop valves connected in series and wherein said stop valves are controllable by the air pressure in said connecting line.

14. The control system of claim 1, wherein said burner is operated within a modulation range of at least 1:3 by use of said motor.

15. The control system of claim 1, wherein said burner is operated within a modulation range of at least 1:3 by use of said motor.

16. The control system of claim 1, wherein said burner is operated within a modulation range of approximate 1:10 by use of said d.c. motor for the blower.

17. The control system of claim 1, wherein said burner is operated within a modulation range of approximate 1:10 by use of said d.c. motor for the blower.

18. The control system of claim 1, further comprising a temperature regulator which changes said conveyed quantity of air by an adjusting parameter which is a function of heat demand.

19. The control system of claim 18, wherein said adjusting parameter is one of external temperature, room temperature of room to be heated, boiler temperature, the flow temperature or any combination thereof.

20. The control system of claim 1, further comprising a temperature regulator which changes said conveyed quantity of air by an adjusting parameter which is a function of heat demand.

21. The control system of claim 20, wherein said adjusting parameter is one of external temperature, room temperature of room to be heated, boiler temperature, the flow temperature or any combination thereof.

22. The control system of claim 1, further comprising a temperature regulator which regulates boiler temperature as function of heat requirement.

23. The control system of claim 22, wherein said heat requirement is one of room temperature, external temperature or combination thereof.

24. The control system of claim 22, wherein said temperature regulator also regulates flow temperature as a function of heat requirement.

25. The control system of claim 24, wherein said heat requirement is one of room temperature, external temperature or combination thereof.

* * * * *